US008109348B2

(12) United States Patent
Lorger et al.

(10) Patent No.: US 8,109,348 B2
(45) Date of Patent: Feb. 7, 2012

(54) DOWN-THE-HOLE HAMMER DRILL

(75) Inventors: Tony Lorger, Eagleby (AU); Daniel Paul Lorger, Rollingstone (AU)

(73) Assignee: Drillroc Pneumatic Pty Ltd, Eagleby, Queensland (AU)

( * ) Notice: Subject to any disclaimer, the term of this patent is extended or adjusted under 35 U.S.C. 154(b) by 144 days.

(21) Appl. No.: 12/445,850

(22) PCT Filed: Oct. 17, 2007

(86) PCT No.: PCT/AU2007/001580

§ 371 (c)(1),
(2), (4) Date: Apr. 16, 2009

(87) PCT Pub. No.: WO2008/046148

PCT Pub. Date: Apr. 24, 2008

(65) Prior Publication Data

US 2010/0300763 A1 Dec. 2, 2010

(30) Foreign Application Priority Data

Oct. 20, 2006 (AU) ..... 2006905840

(51) Int. Cl.
*E21B 4/14* (2006.01)
*B23B 39/10* (2006.01)
*B25G 3/32* (2006.01)

(52) U.S. Cl. ..... 175/296; 173/13; 403/355

(58) Field of Classification Search ..... 175/296, 175/305; 173/13, 17, 16, 15; 403/351, 353, 403/355; 464/162, 167
See application file for complete search history.

(56) References Cited

U.S. PATENT DOCUMENTS 1,220,483 A * 3/1917 Williams et al. ..... 464/162
2,665,115 A * 1/1954 Bassinger ..... 173/121
(Continued)

FOREIGN PATENT DOCUMENTS

EP 244986 A * 11/1987
(Continued)

OTHER PUBLICATIONS

Formed. 2011. In Merriam-Webster Online Dictionary. Retrieved Mar. 8, 2011, from http://www.merriam-webster.com/dictionary/formed.*

(Continued)

*Primary Examiner* — Giovanna Wright
*Assistant Examiner* — Kelly Shaw
(74) *Attorney, Agent, or Firm* — Shoemaker and Mattare

(57) ABSTRACT

There is provided a downhole hammer including a drill bit (2) retained by short (4) and long (5) drive pins in the bore of a driver chuck (1). The chuck (1) and bit (2) shank have machined longitudinal grooves (3), every second bit shank groove being blind and connected to the adjacent open groove by a short-pin length relief. The shorter pins (4) are inserted into the visible holes formed by the alignment of the open drill bit grooves and driver chuck grooves (3). The chuck (1) is then indexed which shunts the short pins (4) sideways until the longer pins (5) are insertable. The driver chuck (1) and drill bit (2) are engaged rotationally. The bit (2) slides by the desired distance due to the shorter pins (4) being entrapped in the blind grooves. The arrangement does not require a bit shank extension to accommodate a conventional bit retainer ring.

23 Claims, 6 Drawing Sheets

U.S. PATENT DOCUMENTS

| | | | | | |
|---|---|---|---|---|---|
| 2,859,733 | A * | 11/1958 | Gardner et al. | 173/71 |
| 2,873,093 | A * | 2/1959 | Hildebrandt et al. | 175/92 |
| 3,416,613 | A * | 12/1968 | Henderson | 173/197 |
| 3,804,181 | A * | 4/1974 | Curington et al. | 173/17 |
| 3,896,886 | A * | 7/1975 | Roscoe, Jr. | 173/17 |
| 3,924,690 | A * | 12/1975 | Shaw | 173/13 |
| 4,254,639 | A * | 3/1981 | Teramachi | 464/167 |
| 4,278,135 | A * | 7/1981 | Curington | 173/29 |
| 4,932,483 | A * | 6/1990 | Rear | 175/296 |
| 5,511,628 | A * | 4/1996 | Holte | 175/296 |
| 5,564,510 | A * | 10/1996 | Walter | 175/296 |
| 5,715,897 | A * | 2/1998 | Gustafsson | 175/296 |
| 5,722,495 | A * | 3/1998 | Rear | 175/296 |
| RE36,848 | E * | 9/2000 | Bui et al. | 175/65 |
| 6,131,672 | A * | 10/2000 | Beccu et al. | 173/91 |
| 6,164,393 | A * | 12/2000 | Bakke | 175/296 |
| 6,454,026 | B1 * | 9/2002 | Shofner | 175/296 |
| 6,543,557 | B2 * | 4/2003 | Gien | 175/296 |
| 6,789,632 | B2 * | 9/2004 | Green | 175/300 |
| 7,712,554 | B2 * | 5/2010 | Gien | 175/417 |
| 2002/0066599 | A1 * | 6/2002 | Gien | 175/92 |
| 2004/0206550 | A1 * | 10/2004 | Gien | 175/92 |
| 2005/0126822 | A1 * | 6/2005 | Campbell et al. | 175/57 |
| 2005/0173158 | A1 | 8/2005 | Jacobsson et al. | |
| 2006/0000646 | A1 * | 1/2006 | Purcell | 175/296 |
| 2007/0102196 | A1 * | 5/2007 | Bassinger | 175/296 |

FOREIGN PATENT DOCUMENTS

| | | | |
|---|---|---|---|
| EP | 548008 | A1 * | 6/1993 |
| IE | 82751 | B3 * | 2/2003 |
| JP | 06212872 | A * | 8/1994 |
| WO | 2006/032093 | | 3/2006 |

OTHER PUBLICATIONS

Integrally. 2011. In Merriam-Webster Online Dictionary. Retrieved Mar. 8, 2011, from http://www.merriam-webster.com/dictionary/integrally.*

* cited by examiner

FIGURE 3B
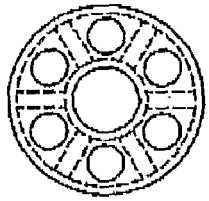
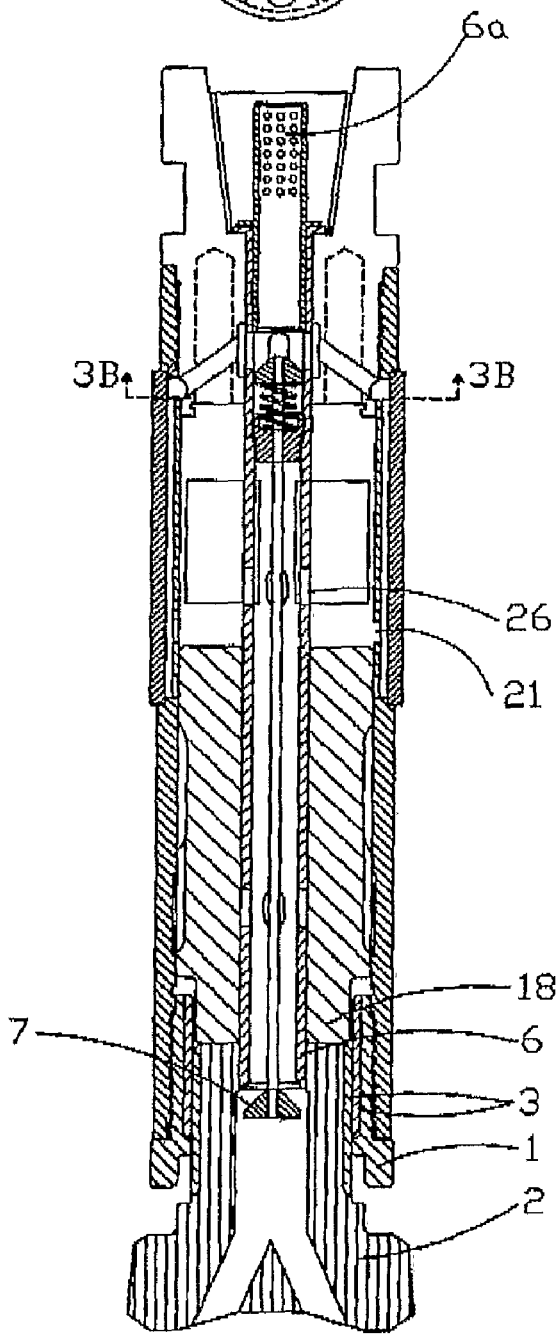
FIGURE 3A

FIGURE 4B
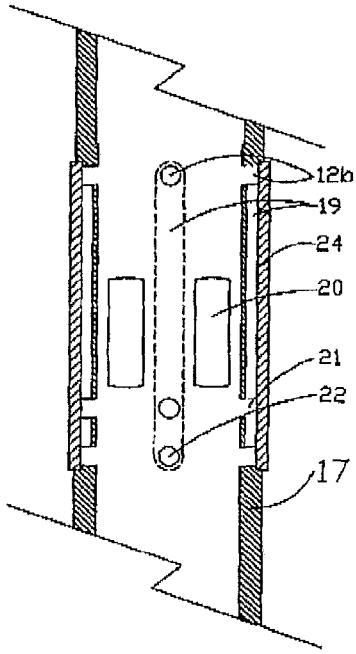
FIGURE 4A
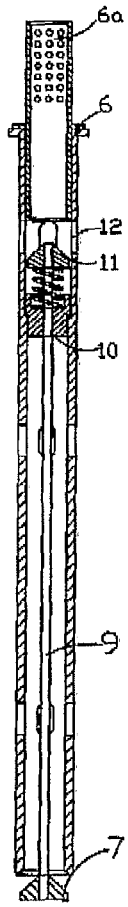
FIGURE 4C
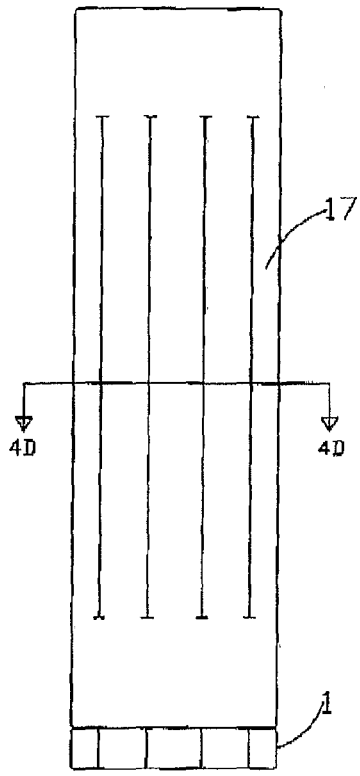
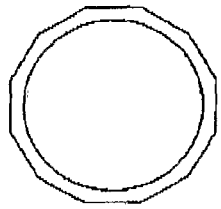
FIGURE 4D

DOWN-THE-HOLE HAMMER DRILL

FIELD OF INVENTION

This invention relates to a down-hole hammer drill.

This invention has particular application to a down-hole compressed fluid driven hammer drill of the type called "conventional", that is, not a recirculating hammer, and for illustrative purposes, reference will be made to this application. It is envisaged this invention may find application in other forms of rotating mechanical engagement, including recirculating hammers and any like apparatus requiring positive and sliding mechanical power transmission, such as dog clutches.

PRIOR ART

The following prior art is mere public information and is not admitted as part of the common general knowledge of the art unless expressly indicated to be so.

Down hole hammers generally comprise a drill bit as the lower most component in the hammer assembly. The drill bit has a major diameter portion referred to as the bit head, and represents the diameter of the hole to be drilled. The bit head is integral with an upper, splined bit shank, which is slidably engaged and retained within a driver chuck. The driver chuck has an internal spline for engagement with the drill bit shank spline, and an outer threaded portion to engage a down hole hammer barrel.

The bit shank splined section, when engaged within the driver chuck, is mechanically engaged radially, but free to slide axially. To limit the extent of axial travel, including the prevention of the drill bit sliding out of engagement altogether, the drill bit shank incorporates a section above the spline, of reduced diameter, for a distance equivalent to the desired travel length of the spline plus the thickness of the retaining mechanism. This retaining mechanism is a bit retainer ring, being of two semi-circular sections with inner and outer diameters that are placed from each side around the reduced diameter of the bit shank thereby forming a near complete ring. The final section above the reduced diameter is the bearing land, which varies in form but is always of substantially larger diameter than the reduced diameter, so as to limit the axial travel as the bearing land comes to rest on the bit retainer ring.

In this fashion, the driver chuck is lowered onto the drill bit shank, the mating splines engaged. The two halves of the bit retainer ring are fitted to the reduced diameter portion of the bit shank and resting atop the driver chuck. The drill bit, chuck and retainer ring sub assembly are threaded into the down hole hammer casing/barrel. The bit retainer ring now encased circumferentially within the down hole hammer barrel, driver chuck below, and drill bit guide bush above, permits limited axial travel of the splined engagement.

The aforementioned drill bit guide bush houses the uppermost portion of the drill bit shank, providing centralization and alignment of the drill bit as it slides along its splined engagement within the driver chuck. Concurrently, in some designs, it provides guidance to the impact end of the reciprocating piston as it impacts the anvil of the drill bit.

Furthermore, an extended guide bush may serve as part of the cyclical porting cycle. The piston may have a reduced diameter for a portion of its lower length, that diameter being a running clearance within the guide bush. As the reduced end of the piston enters the guide bush prior to impact with the drill bit, a closed chamber is formed above said guide bush in which fluid is trapped and progressively compressed until impact between the piston and drill bit. The compressed fluid (usually air), combined with some rebound resulting from impact, takes the piston back to the top of its stroke, by which time the porting system has energized the upper chamber with pressurised fluid, to drive the piston back down for the impact stroke. Where an extended guide bush is not used as part of the cyclical porting cycle, a tubular foot valve/exhaust tube may serve to create the rebound pressure chamber.

Most conventional down hole hammers have a poppet type check valve located within a top adapter sub-assembly (or "sub") at the top of the internal assembly as the entry point of the compressed fluid. The check valve is supported by or integral with an air distributor or like component, sealing an inlet chamber above a piston from a piston compression chamber below the piston, and distributing the compressed fluid from one to the other via the porting system.

U.S. Pat. No. 6,131,672; U.S. Publication No. 20060000646; U.S. Publication No. 20050173158 and European Doc. WO 2006032093 A1 are all representative of the design principles described above.

A further design standard is the use of a tube, usually of acetyl thermoplastic, fitted into the top of a known drill bit shank and protruding beyond the anvil face, usually by about 50 millimetres or so, forming part of the cyclic operation of most known down hole hammers, known as a foot valve or exhaust tube. Some manufacturers have eliminated the necessity of said exhaust tube in some models by means of an extended drill bit guide bush such as in U.S. Pat. No. 6,131,672; while other manufacturers utilize both a drill bit guide bush and exhaust tube foot valve such as in U.S. Publication No. 20050173158, and European Document No. WO 2006032093.

There are in general two types of porting arrangements in known down hole hammers:

1) those with a ported hollow feed tube co-operating with a ported piston, such as in U.S. Pat. No. 6,131,672, and
2) those with a ported inner cylinder, co-operating with a non-ported piston, such as U.S. Publication No. 20060000646.

U.S. Publication No. 20060000646 states several reasons why a ported inner cylinder can be problematic, and proceeds to describe an improved arrangement for mounting of a ported inner cylinder. While the improved mounting arrangement may negate machining of weakening grooves in the outer cylinder, as is one essential element of the invention, it does so at a price, namely more components and therefore a higher manufacturing cost.

The advantage, however, of the inner cylinder style of porting is that the piston does not require porting. Hence piston breakage failure frequency in ported inner cylinder type down hole hammers is significantly lower than of the ported piston type, and so both types are favoured for each of their advantageous characteristics.

It is desirable to have a hammer wherein the constraints inherent in both porting arrangements described above are avoided.

DESCRIPTION OF THE INVENTION

As used herein the word "comprising" and its parts is to be taken as non-exclusive, unless context indicates clearly to the contrary.

This invention in one aspect resides broadly in a down-hole hammer drill including:

1) a hammer casing;
2) a free piston motor in the casing:
3) a drill bit having a bit shank extending from a bit head to an anvil end, the bit shank being keyed for reciprocating and driven rotation in the bore of a driver chuck secured to the lower end of the casing, at least one said key including a blind keyway in said bit to retain the bit in said chuck and being of a length selected to allow a selected reciprocal motion of said drill bit.

The hammer casing may take any suitable form but will usually be generally cylindrical in form and will include a bore in which the free piston may reciprocate. The casing may be machined from a plain cylindrical stock or may be fabricated from components. Particularly the casing may include a substantially cylindrical casing having fluid control passages machined into the outer surface thereof and encased in sleeve closing over the passages to encapsulate the passages in the hammer wall. The inner casing wall may then be ported as appropriate from the bore to the passages. By this means the inner sleeve arrangement of prior art hammers may be simply avoided.

The top end of the casing is preferably connected to a pressurized drill string by a top sub-type adapter, the string and adapter forming a compressed fluid (usually air) supply for the free piston motor. The top sub may be secured to the casing by any suitable means such as by threaded engagement.

The free piston motor may include a free piston mounted for reciprocation in the bore. The piston may have a lower pneumatically-worked hammer face and a pneumatically-worked upper face. The hammer face may impact directly onto the anvil end of a drill bit shank. The piston preferably cooperates with the housing to provide at least part of the porting required to operate the free piston motor. The piston divides the casing into an upper working chamber defined between the upper face and the top sub and a lower working chamber between the hammer face and the anvil end of the bit shank and driver chuck. The upper working chamber may be modified to enhance its performance as an air spring. For example the top sub may be relieved above the working chamber per se to provide for a reserve chamber volume into which air may be compressed by the piston rebounding upward.

The free piston preferably slides on an air control assembly including a ported porting tube extending axially from an air supply associated with the top sub to an axial bore in the shank of the bit, the bit reciprocating on the end of the tube to guide exhaust air through discharge ports at the cutting face of the bit. The air control assembly may include an upper check valve openable by supply pressure against a spring bias in response to reduced pressure in whichever of the upper and lower working chambers is at reduced pressure in the cycle. The upper check valve may be a poppet type valve linked by a control rod to a lower poppet valve to coordinate the valving to exhaust of the opposite chamber to that being supplied by the upper poppet valve.

The incorporation of the check valve(s) within the porting tube is advantageous as a feature allowing the elimination of an "air distributor" and subsequently the dramatic shortening of the top end of the hammer assembly when compared to prior art hammers. The embodiments described above may use a check valve tube forming a seat for the upper poppet and incorporated into the upper end of the porting tube. The check valve tube may comprise a perforate cylinder of the like functioning as a debris screen. In the alternative the upper poppet may be independent of the lower check valve in that the check valve tube and poppet valve may be associated with a spring and form a poppet valve assembly locatable at the upper end of the porting tube.

By incorporation of this simple air management feature, the upper hammer may be considerably foreshortened as compared with hammers using a conventional air distributor system.

The driver chuck may be secured to the lower end of the casing by any suitable means. The chuck may be connected directly to the casing or may be connected via a gauge ring or sleeve. The driver chuck may be secured by threaded engagement. The driver chuck bore preferably fits over the drill bit shank and is a running fit, free to rotate in the absence of keys. The driver chuck may be formed integrally with the casing.

The keying may be by any suitable means. For example, the inside of the driver chuck and the outside of the drill bit shank may be machined to form a plurality of opposed longitudinal grooves, rotation of the driver chuck on the drill bit shank serving to selectively align the grooves. In this embodiment the at least one blind keyway may comprise one or more alternate ones of the grooves in the bit shank wall. Relatively short pins may be inserted into the visible holes formed by the alignment of the open (i.e., not blind) bit shank grooves. The shank may be relieved between adjacent respective grooves for part of their length and the chuck then indexed until the next alignment of the grooves, and longer pins inserted. At this point the driver chuck and drill bit are engaged rotationally, and by means of the design, the shorter pins now no longer visible but engaged internally, inclined axially and spaced radially. The bit may freely slide by the desired distance due to the internal engagement of the shorter pins with the cooperating blind and chuck groove.

Alternatively, the shorter pins may be secured to one or the other of the bit and chuck, or may be formed integrally with it. The longer pins or keys may provide the majority of rotational drive engagement.

The pins, both long and short, may be considered sacrificial drive engagement pins, or keys, and may be of any suitable cross sectional shape as is practical and of any number as is practical. For example, the pins may be round section drive pins or may be of a section more akin to a keyway key.

Alternatively, the keying may be by way of insertion of the shorter pins through drilled or milled holes in the driver chuck side wall, such stroke limiting pins in turn retained in place once the driver chuck and drill bit assembly is fitted into the barrel.

In another aspect, this invention in one aspect resides broadly in a down-hole hammer drill including:

1) a hammer casing; and 2) a free piston motor in the casing impacting a drill bit having a bit shank extending from a bit head to an anvil end, the bit shank being keyed for reciprocating and driven rotation in the bore of a driver chuck secured to the lower end of the casing, the bit shank having a drive keyway extending from the anvil end and a blind keyway spaced from the anvil end, the material of the bit shank being relieved between the drive and blind keyways along part of their length to allow a key in the drive keyway to be moved to the blind keyway by part rotation of the bit shank and advanced by advancing the bit into the chuck bore, the bit shank being retained against counter rotation by an elongate drive key installed in the drive keyway.

The bit and chuck combination described above may be made with a considerably shorter bit shank because the bit retainer is coterminous with the replacement for the drive splines. The bits are accordingly more cost effective to produce, and are potentially lighter or at least may have proportionately more working bit head metal for a given weight.

The hammer may be made all the shorter where the porting tube of the preferred form of the present invention is used. In a further aspect this invention resides broadly in a downhole hammer including a hammer casing, a top sub adapting the hammer casing to a drill string and compressed working fluid supply, a drill bit rotated by a shank thereof in a driver chuck secured to the lower end of the casing, a free piston in an axial hammer bore and driven by said supply to repeatedly strike the back end of the bit shank, characterised in that the piston has an axial piston bore by which it slides on a porting tube extending from the top sub fluid supply to an axial shank bore, the porting tube having a check valve at its upper end to admit fluid to an upper chamber in porting tube, the upper chamber venting through lateral passages to air passages supplying working fluid pressure to the upper and lower working chambers acting on the upper and lower faces of the piston through ports opened and closed in response to the piston position in the bore, respective upper and lower exhaust ports selectively opened and closed by movement of the piston and exhausting fluid from the working chambers into a lower porting tube chamber, and a lower check valve admitting exhaust air to said axial shank bore for distribution to the cutting face of the bit.

BRIEF DESCRIPTION OF THE DRAWINGS

The invention will be further described with reference to a embodiments of the invention as illustrated in the accompanying drawings and wherein:

FIG. 3A is the hammer assembly of FIG. 1 lifted away from contact with the rock;

FIG. 3B is a view of the top adapter sub through section 3B of FIG. 3A.

FIG. 4A is a sectional elevation of the barrel porting construction of the down hole hammer assembly of FIG. 1;

FIG. 4B is a view of the hollow porting tube of the apparatus of FIG. 1;

FIG. 4C is an elevation of the barrel and driver chuck exterior of the apparatus of FIG. 1;

FIG. 4D is a sectional view indicating the polygonal outer surface of the barrel and driver chuck exterior of the apparatus of FIG. 1;

DESCRIPTION OF THE EMBODIMENTS

Figure 1:
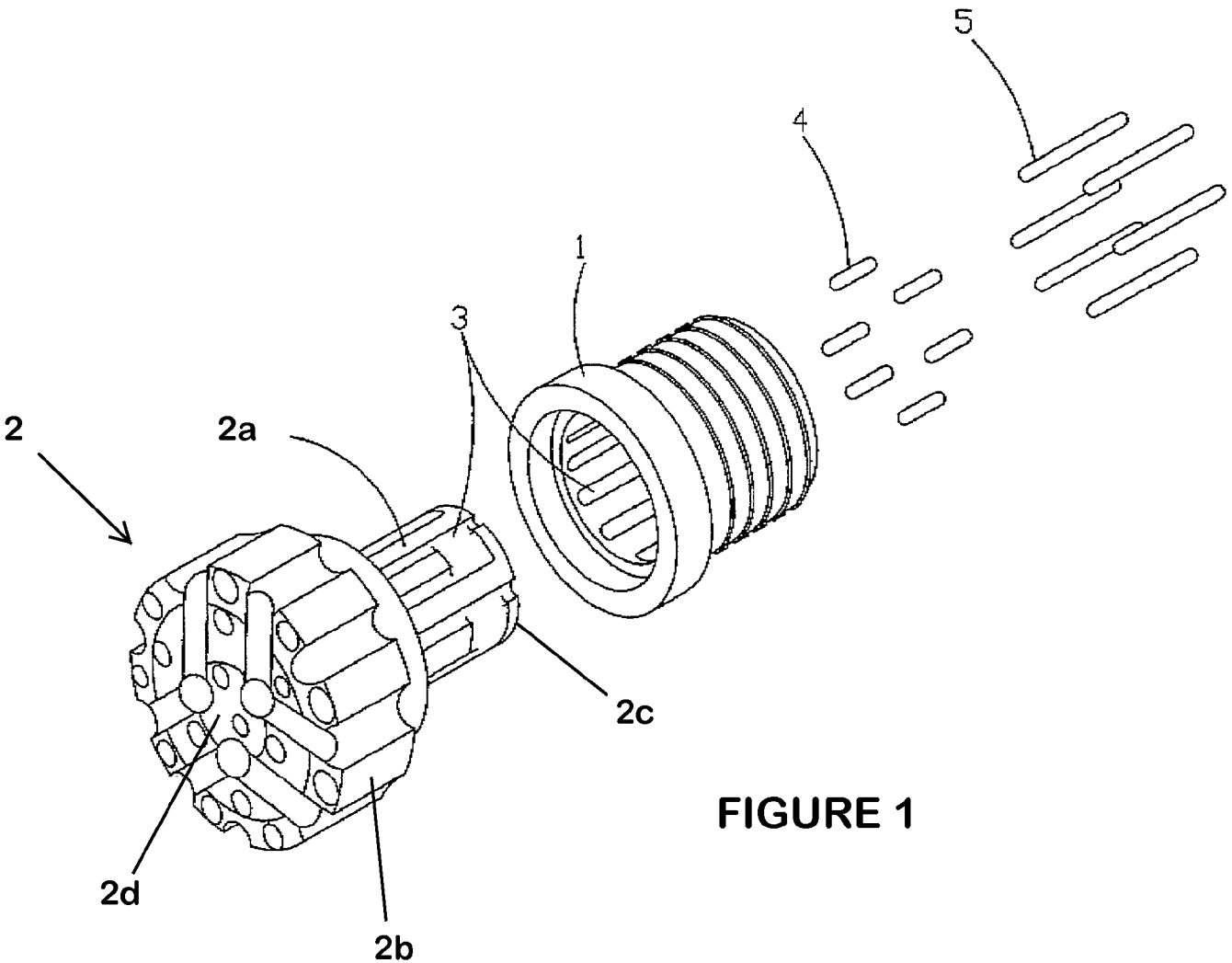
FIG. 1 shows an isometric exploded view of apparatus in accordance with the present invention.
Figure 2:
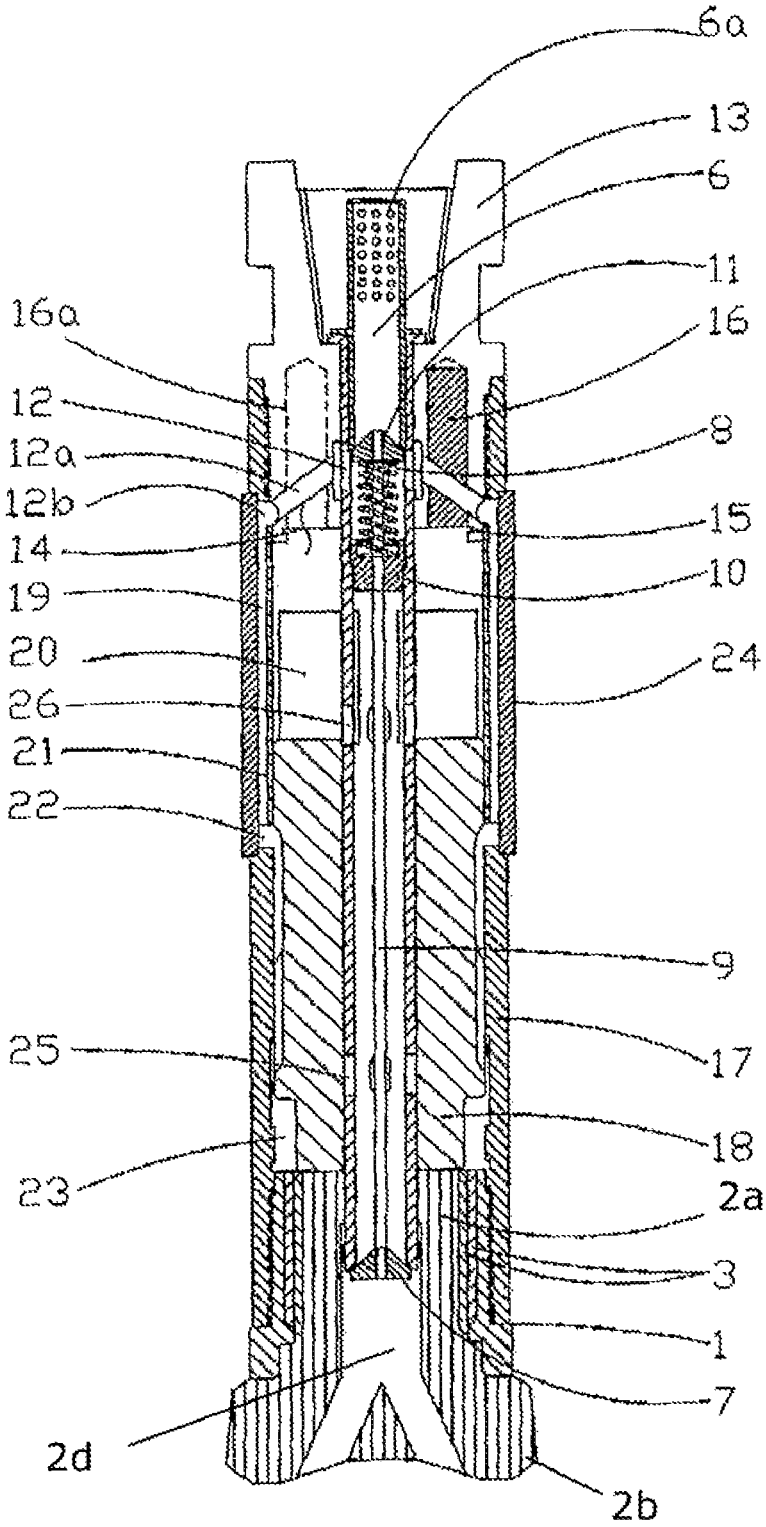
FIG. 2 shows an axial section of the down hole hammer assembly of FIG. 1.

FIG. 1 shows a driver chuck 1 and a drill bit 2 having a shank 2*a*, a head 2*b* and an anvil end 2*c*. FIGS. 2-4 show a hammer drill which includes the driver chuck and the bit. The driver chuck 1 fits over the drill bit shank 2*a* and has a running fit, free to rotate. In the inside of the driver chuck and on the outside of the drill bit shank are machined longitudinal grooves 3. The parts are assembled by rotating the driver chuck on the drill bit shank until the grooves align. The shorter pins 4 are inserted into the visible holes formed by the alignment of the drill bit grooves and driver chuck grooves 3, the chuck then indexed until the next alignment of the grooves, and the longer pins 5 inserted. At this point the driver chuck and drill bit are engaged rotationally, and by means of the design, the shorter pins 4 now no longer visible but engaged internally, inclined axially and spaced radially, the bit may freely slide by the desired distance due to the internal engagement of the shorter pins. Further, the shorter pins which determine the allowable sliding movement may be formed integral with either the drill bit or driver chuck, the longer pins, or keys, providing the majority of rotational drive engagement. Alternately the longitudinal grooves 3 shown formed within the driver chuck 1 may otherwise be formed directly into the lower portion of the barrel bore, rendering the driver chuck entirely obsolete, the design of the present invention lending itself practically to such an arrangement.

The aforementioned pins, both long and short, are sacrificial drive engagement pins, or keys, and may be of any suitable cross sectional shape as is practical and of any number as is practical.

It is envisaged the foregoing drive arrangement is a practical and useful mechanical drive coupling where limited or predetermined stroke is required, and where sacrificial and replaceable drive elements are advantageous.

With reference particularly to FIG. 2, compressed air enters hollow port tube 6 through central bore of top adapter sub 13, forces open pressure port check valve 11 against a spring 8 supported by choke plug 10, simultaneously opening exhaust check valve 7 via connecting rod 9. Compressed air passes through pressure port 12, through conduit 12*a*, aligning with feed port 12*b* to pressurize porting channel 19, to feed delivery ports 21 and 22. Lower chamber 23 is energized by delivery port 22 to raise the piston 18. As the piston rises, lower chamber 23 dumps to atmosphere via exhaust port 25, delivery ports 21 and 22 begin to energize the piston compression chamber 14 via transfer ports 20, the piston is forced down to impact the drill bit anvil end 2*c*, dumping the piston compression chamber to atmosphere when exhaust port 26 is exposed, and the cycle repeats continually while sufficient compressed fluid is supplied, or unless the cycle is interrupted.

With reference to FIG. 3A, in operation, the hammer has been lifted away from contact with rock, the drill bit 2 is free to fall away the distance permitted by the internally engaged shorter pins 4 shown in FIG. 1, located within axial grooves 3, followed by the reduced diameter striking end of piston 18 entering the upper portion of driver chuck 1 vacated by the drill bit 2, thereby interrupting the percussive cycle as delivery port 21 becomes open to exhaust port 26 and dumps to atmosphere through exhaust check valve 7 until the cycle is reactivated. Note the hollow porting tube 6 remains in co-operation with the drill bit bore at all times.

In the present invention, the lower check valve arrangement is made possible due to the hollow porting tube 6 extending from its upper support in the central bore of top adapter sub 13 into the central bore of drill bit 2, and may be utilised as either an upper pressure check valve 11 or lower check valve 7, or both in unison via connecting rod 9. The cooperation of the porting tube within the drill bit serves several purposes. Firstly, alignment of the porting tube is fortified; secondly it permits an advantageous location of an exhaust check valve. The advantage of said lower exhaust check valve being the positive and instant prevention of debris contamination at the first possible point of entry, the design of the present invention is therefore considerably more resistant to entry of potentially damaging debris than down hole hammers of known design.

Thirdly, the porting tube 6 controls the piston return chamber 23 volume, thereby eliminating requirement of a component known as a foot valve or exhaust tube, as described earlier in prior art.

In the present embodiment, co-operation of the hollow porting tube and drill bit is made practicable due to the aforementioned driver chuck and drill bit combination design, in that the drill bit shank 2*a* in the present invention is well supported in alignment within the driver chuck 1, has a substantial wall thickness and a bore 2*d* (FIG. 2) able to accommodate a porting tube of sufficient cross sectional area for the required airflow, the drill bit bore being fashioned to provide sufficient cross sectional area for passage of exhaust fluid through the check valve 7.

In known down hole hammers, the upper piston compression chamber is always below the top adapter sub and air distributor, and of a fixed volume, with limited scope for adjustment or alteration. In the present invention a piston compression chamber 14 is formed integrally within the top adapter sub 13, and a means to quickly and simply alter the piston compression chamber 14 volume.

With reference to FIG. 2, the adjustment is performed thus; within piston compression chamber 14 as part of the top adapter sub 13, is formed a series of axial holes 16*a*, and into the piston compression chamber holes are placed any practical number of inserts 16, retained by known means, such as a circlip into groove 15, thereby incrementally altering the volume capacity of said chamber, subsequently altering compressed fluid consumption and maximising efficiency of the present invention for any suitable compressor delivery output.

Attention is drawn to FIG. 4A. The construction of barrel porting is described.

Ports 12*b*, 21, and 22 are radially through drilled into the barrel 17. Channel 19 is milled longitudinally at a suitable depth, and length as to encompass the drilled ports.

Cap 24 is fixed in known manner to cover and seal the ports from the outside. Thus, ports 12*b*, 21 and 22 are interconnected by a passage 19 formed between inner and outer surfaces of barrel 17.

Internal transfer ports 20 are fly-cut into the barrel bore in known manner. The effect on torsional rigidity is minimal and acceptable because approximately six percent of the barrel circumference is affected per channel since the porting channel 19 need only have a cross sectional area equal to any one of the supply or delivery ports, and much of the removed metal is restored as a cover cap 24. Furthermore, it is not necessary to fashion said cover cap flush fitting with the barrel outside diameter, it would be entirely acceptable if the cover cap were to protrude the barrel outside diameter up to but not exceeding the diameter of the drill bit, if so desired.

In summary, we have found there to be ample material thickness to accommodate a fluid conduit 19 in the manner described. This is advantageous in that material input is kept at a minimum since manufacturing of an inner cylinder is negated, as are the problematic methods of retaining said inner cylinder.

The present invention described thus far is of non-ported piston type design. Whilst the general flow characteristics of this type of porting are known and not part of this patent application, it has a bearing on how some of the components are designed, and therefore, we have produced a second embodiment of the invention maintaining all of the essential and claimed features of the invention in the first embodiment, with some altered features according the porting arrangement of a ported piston.

Figure 5:
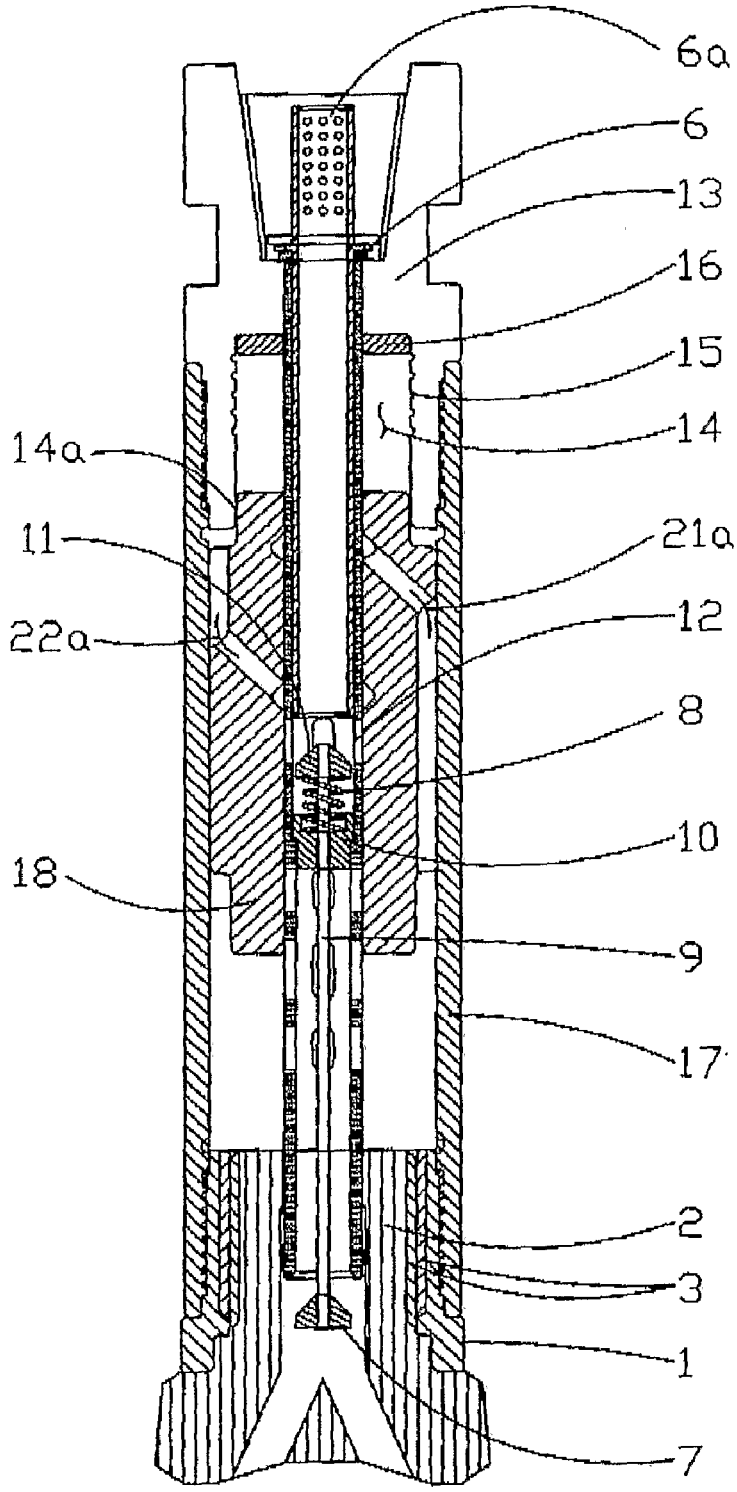
FIG. 5 is a sectional elevation of an alternative embodiment of the present invention.
Figure 6:
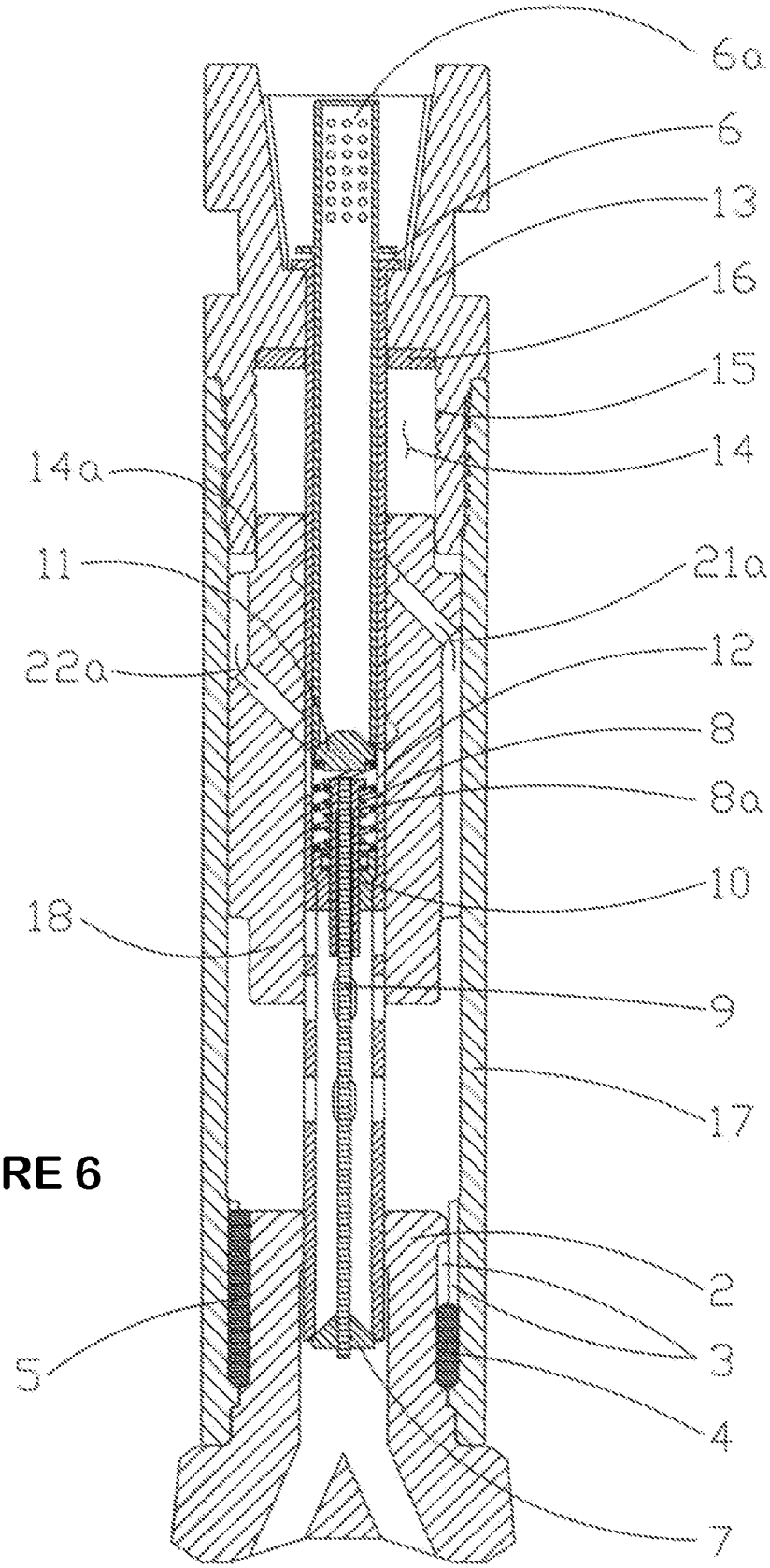
FIG. 6 is a sectional view of another embodiment in which the the upper poppet is independent of the lower check valve.

With reference to FIG. 5, this second embodiment is substantially similar in construction and operation to the first embodiment of FIGS. 1 to 4, and like reference numbers denote like components.

Compressed air enters porting tube 6 and directly pressurises the hammer via pressure supply port 12 to begin operation, in turn the check valve 7 is forced open by exhaust fluid against its spring 8 via connecting rod 9. Such spring is supported by choke plug 10. The check valve arrangement may also be a sliding piston 11 atop the spring which is forced down against the spring by incoming compressed fluid, thus exposing the pressure supply port 12. The check valve arrangement is thus mounted internally within the hollow porting tube, and may be either, or both the aforementioned arrangements in unison. (see FIG. 4B)

With reference particularly to FIG. 5, within the piston compression chamber 14 as part of the top adapter sub 13, is formed a series of retainer circlip grooves 15, and into the piston compression chamber is placed an insert or inserts 16, retained by a circlip (not shown) in an appropriate one of said grooves 15, thereby altering the volume capacity of said chamber, subsequently altering compressed fluid consumption and maximising efficiency of the present invention for any suitable compressor delivery output.

With further reference to FIG. 5, the piston 18 is ported from its upper and lower extremities via porting conduits 21*a* and 22*a*, such porting conduits co-operating with porting apertures in hollow porting tube 6 to effect reciprocal motion, and may be fashioned to slidably co-operate at the top of its stroke with the bore of said piston compression chamber at 14*a* in FIG. 5.

A long standing problem associated with the use of known down hole hammers is the difficulty of disassembly, due to the great torsional forces and vibration which cause the threads to become very tight and therefore difficult to undo. Hence there is a need for specialty equipment to grip and apply high force to disassemble the down hole hammer for servicing, and often there is the persistent problem of the gripping tool or mechanism to slip, or fail to grip, on the hard outer cylindrical surface of a known down hole hammer assembly.

In the present invention, for reasons of safety and ease of handling, are provided longitudinal flats on the outer surfaces of the barrel and driver chuck (see FIGS. 4C and 4D), typically twelve in number. Such a peripheral shape creates no notable restriction to the passing by of exhaust air laden with crushed rock when drilling, but provides additional assurance of positive non-slip attachment of appropriate servicing tools, such as in Publication No. WO 2006015454.

It will of course be realised that while the above has been given by way of illustrative example of this invention, all such and other modifications and variations thereto as would be apparent to persons skilled in the art are deemed to fall within the broad scope and ambit of this invention as defined in the following claims.

The invention claimed is:

1. A down-hole hammer drill including:

a hammer casing;

a top sub at the upper end of said casing and adapted to connect the hammer to a pressurized drill string, the drill string and top sub forming a compressed air supply;

a drill bit having a bit shank extending from a bit head to an anvil end, the bit shank being mounted for reciprocating and driven rotation in the bore of a driver chuck secured to the lower end of the casing, said mounting for reciprocating and driven rotation comprising a plurality of key and keyway pairs arranged in spaced relation circumferentially about the bit shank of the driver chuck bore, at least one said keyway being blind at its ends, and at least one other keyway opening to said anvil end, whereby the blind keyway and said key in it are each of a length selected to allow a selected reciprocal motion of said drill bit, the sidewall of said blind keyway being relieved toward a circumferentially adjacent keyway for at least a blind keyway length, said key being inserted into the adjacent keyway, and then indexed with the blind keyway by rotation of the bit in the chuck, insertion of keys into the keyways opening to said anvil end rotationally locking the driver chuck to the drill bit;

a free piston motor powered by said air supply and dividing the casing into an upper working chamber defined between an upper piston face and the top sub and a lower working chamber between a piston hammer face and the anvil end of the bit shank and driver chuck;

an air control assembly on which the free piston slides and including a ported tube extending axially from said air supply to an axial bore in the shank of the bit to guide exhaust air through discharge ports at the cutting face of the bit, the bit reciprocating on the end of the tube; and an upper check valve in the air control assembly and openable by supply pressure against a spring bias in response to reduced pressure in whichever of the upper and lower working chambers is at reduced pressure in the cycle.

2. A down-hole hammer drill according to claim 1, wherein the hammer casing includes a substantially cylindrical casing having fluid control passages machined into the outer surface thereof and encased in cover cap closing over the passages to encapsulate the passages in the hammer wall.

3. A down-hole hammer drill according to claim 1, wherein the piston cooperates with the housing to provide at least part of the porting required to operate the free piston motor.

4. A down-hole hammer drill according to claim 1, wherein the upper working chamber includes a relief of the top sub above the working limit of the piston to provide for a reserve chamber volume into which air may be compressed by the piston rebounding upward.

5. A down-hole hammer drill according to claim 1, wherein the upper check valve is a check valve linked by a control rod to a lower poppet valve to coordinate the valving to exhaust of the opposite chamber to that being supplied by the upper poppet valve.

6. A down-hole hammer drill according to claim 5, wherein the upper check valve is a check valve independent of the lower poppet valve.

7. A down-hole hammer drill according to claim 1, wherein the upper check valve seats against a check valve tube, the check valve tube and poppet valve being associated with a spring and forming a poppet valve assembly incorporated with the upper end of the ported tube.

8. A down-hole hammer drill according to claim 1, wherein the driver chuck is secured directly to the lower end of the casing.

9. A down-hole hammer drill according to claim 8, wherein the driver chuck is secured by threaded engagement.

10. A down-hole hammer drill according to claim 1, wherein the driver chuck is secured to the lower end of the casing via a gauge ring or sleeve.

11. A down-hole hammer drill according to claim 1, wherein the driver chuck is formed integrally with the casing.

12. A down-hole hammer drill according to claim 1, wherein the keying is provided by the inside of the driver chuck and the outside of the drill bit shank being machined to form a plurality of opposed longitudinal grooves, rotation of the driver chuck on the drill bit shank serving to selectively align the grooves to accept drive pins.

13. A down-hole hammer drill according to claim 12, wherein the at least one blind keyway comprises one or more alternate ones of the grooves in the bit shank wall, the shank being relieved between adjacent respective grooves for part of their length, short drive pins being inserted into the visible holes formed by the alignment of the open bit shank grooves, the chuck then indexed until the next alignment of the grooves locating the short drive pins in the blind grooves and longer pins inserted to engage the driver chuck and drill bit rotationally.

14. A down-hole hammer drill according to claim 12, wherein the pins are selected from being secured to one or the other of the bit and chuck, and formed integrally with one or of the other of the bit and chuck.

15. A down-hole hammer drill according to claim 12, wherein the pins are round section drive pins.

16. A down-hole hammer drill according to claim 12, wherein the pins are sacrificial and wear preferentially to the driver chuck and bit.

17. A down-hole hammer drill according to claim 1, wherein the keying is provided by way of insertion of drive pins through drilled or milled holes in the driver chuck side wall and forming stroke limiting pins which are retained in place once the driver chuck and drill bit assembly is fitted into the casing.

18. A down-hole hammer drill including:

a hammer casing; and a free piston motor in the casing impacting a drill bit having a bit shank extending from a bit head having a cutting face to an anvil end, the bit shank being keyed for reciprocating and driven rotation in the bore of a driver chuck secured to the lower end of the casing, the bit shank having a drive keyway extending from the anvil end and a blind keyway spaced from the anvil end, the material of the bit shank being relieved between the drive and blind keyways along part of their length to allow a key in the drive keyway to be moved to the blind keyway by part rotation of the bit shank and advanced by advancing the bit into the chuck bore, the bit shank being retained against counter rotation by an elongate drive key installed in the drive keyway.

19. A down-hole hammer drill according to claim 18, wherein the free piston motor includes an axial porting tube on which a free piston slides in a bore in the hammer casing and extending from a compressed air supply associated with a top sub of the down hole hammer drill and an axial bore in the drill bit shank allowing exhaust air to pass through the bit to the cutting face.

20. A down-hole hammer drill according to claim 19, wherein the porting tube has an upper check valve passing compressed air to lateral passages, said check valve alternately supplying air pressure to upper and lower working chambers acting on respective upper and lower faces of the piston respectively, through ports opened and closed in response to the piston position in the bore in the hammer casing, respective upper and lower exhaust ports selectively opened and closed by movement of the piston and exhausting air from the working chambers to a portion of the porting tube separated from said upper check valve by a choke plug, and through a lower check valve admitting exhaust air to said axial shank bore for distribution to the cutting face of the bit.

21. A down-hole hammer drill according to claim 20, wherein the upper check valve is a poppet valve linked by a control rod to a lower poppet valve to coordinate the valving to exhaust of the opposite chamber to that being supplied by the upper poppet valve.

22. A down-hole hammer drill according to claim 20, wherein the upper check valve is a poppet type valve independent of a lower check valve.

23. A down-hole hammer drill according to claim 20, wherein the upper check valve seats against a check valve tube, the check valve tube and poppet valve being associated with a spring and forming a poppet valve assembly incorporated with the upper end of the ported tube.

* * * * *